US009032770B2

(12) United States Patent
Boguslavsky et al.

(10) Patent No.: US 9,032,770 B2
(45) Date of Patent: May 19, 2015

(54) STAMPING WITH ROLLING METHOD AND A DEVICE FOR IMPLEMENTING SAME

(76) Inventors: Boris Zelmanovich Boguslavsky, Kazan (RU); Boris Semenovich Litvak, Moscow (RU)

( * ) Notice: Subject to any disclaimer, the term of this patent is extended or adjusted under 35 U.S.C. 154(b) by 567 days.

(21) Appl. No.: 13/262,973

(22) PCT Filed: Oct. 30, 2009

(86) PCT No.: PCT/RU2009/000592

§ 371 (c)(1),
(2), (4) Date: Dec. 19, 2011

(87) PCT Pub. No.: WO2010/117298

PCT Pub. Date: Oct. 14, 2010

(65) Prior Publication Data

US 2012/0085137 A1 Apr. 12, 2012

(30) Foreign Application Priority Data

Apr. 6, 2009 (RU) ..... 2009112530

(51) Int. Cl.
*B21H 1/18* (2006.01)
*B21J 9/02* (2006.01)

(52) U.S. Cl.
CPC .. *B21H 1/18* (2013.01); *B21J 9/025* (2013.01)

(58) Field of Classification Search
CPC ..... B21B 31/22; B21B 31/30; B21B 35/02; B21B 35/12; B21B 35/144
USPC ..... 72/84, 85, 102, 111, 189, 212, 213, 72/220, 240, 244, 245, 249, 250, 252, 406, 72/452.8, 452.9, 450, 453.01, 453.02
See application file for complete search history.

(56) References Cited

U.S. PATENT DOCUMENTS

| | | | | | |
|---|---|---|---|---|---|
| 2,969,700 | A | * | 1/1961 | Krause | 72/220 |
| 3,102,443 | A | * | 9/1963 | Dell et al. | 72/189 |
| 3,921,429 | A | * | 11/1975 | Sendzimir | 72/189 |
| 4,614,103 | A | * | 9/1986 | Takagi et al. | 72/243.2 |
| 5,070,718 | A | | 12/1991 | Thomas | |
| 5,195,351 | A | * | 3/1993 | Heitze | 72/407 |
| 5,600,995 | A | * | 2/1997 | Sherman | 72/451 |
| 6,467,323 | B1 | * | 10/2002 | Narushima et al. | 72/184 |

FOREIGN PATENT DOCUMENTS

RU 2 338 615 C2 11/2008

* cited by examiner

*Primary Examiner* — Shelley Self
*Assistant Examiner* — Gregory Swiatocha
(74) *Attorney, Agent, or Firm* — Nath, Goldberg & Meyer; Jerald L. Meyer; Katelyn J. Bernier

(57) ABSTRACT

A blank rolled in transverse directions with respect to the longitudinal axis of the blank, and with the aid of a drive for rockingly moving rolls in opposite directions, ensures that the geometry and dimensions of finished parts do not coincide with the form and dimensions of a die. A four-link articulation mechanism lifts/lowers the upper roll and transmits a rolling force thereto. Rods of hydraulic torque cylinders pivotally connect to ends of a rocker thereby transmitting oppositely directed torques and a rolling force to a lower roll. A wedge mechanism coupled to the lower end face of the lower thrust bearing lifts/lowers the lower roll thereby transmitting a rolling force thereto. A rack bar disposed between retainers horizontally moves during rolling and secures the blank using a cradle.

9 Claims, 7 Drawing Sheets

STAMPING WITH ROLLING METHOD AND A DEVICE FOR IMPLEMENTING SAME

This is a National Phase Application filed under 35 U.S.C. §371 as a national stage of PCT/RU2009/000592, filed on Oct. 30, 2009, an application claiming the benefit under 35 U.S.C. §119 of Russian Application No. 2009112530, filed on Apr. 6, 2009, the content of each of which is hereby incorporated by reference in its entirety.

FIELD OF THE INVENTION

The invention relates to the field of metal forming and may be used in production processes and equipment for stamping with rolling.

DESCRIPTION OF THE PRIOR ART

As compared to common methods for stamping (without rolling), a process of stamping with rolling enables production of large-sized forged pieces from hardly deformable steels and alloys, which may not be produced on conventional forging machines. One of the developmental directions in the technology of stamping large-size solid-stamped forged pieces is stamping based on locally continuous deformation of blanks, i.e., stamping with rolling. Here, a maximum stamping force is reduced, which enables increased forging weights, thereby improving the metal use factor and decreasing specific quantities of metal in machines to be designed.

Various types of equipment intended for stamping with rolling are known (SU, No. 444585), (SU, No. 444651), (SU, No. 533427), (SU, No. 533428), (SU, No. 617126), (SU, No. 915336), (SU, No. 1186331), (SU, No. 1253698).

All of them are characterized by the fact that according to the methods for stamping with rolling, as described therein, a blank, which is arranged in a die, is rolled by a roll connected to a drive thereby imparting jigging motion to the roll when the latter is pressed to the blank with a certain force. All the above technical solutions use cross motion (rotation) of the roll relative to the longitudinal axis of a blank, and, in essence, differ from each other by the drive design that imparts jigging motion to the roll. When the drive is operated, jigging motion is imparted to the roll, i.e., pendulum-type motion during which any straight line located on the roll working surface longitudinally relative to its axis of rotation oscillates like a pendulum, and the roll regularly changes the direction of rolling (rotation).

However, when the roll is moved, the roll working surface inevitably slips on the blank surface. This is caused by the fact that a major deformation of the blank takes place in the area of working (rolling) where the roll working surface directly contacts the blank. During this process, as opposed to common stamping methods, metal layers of the blank are deformed non-uniformly, since the upper metal layers, as well as those located lengthwise in the blank and closer to the working area, are deformed to a greater extent than the lower layers.

Slipping of the roll working surface on a blank subjected to stamping with rolling may be reduced by increasing the maximum force of stamping and reducing the rolling speed, but in such a case energy consumption of the process increases, the equipment becomes metal-intensive, its wear resistance decreases, and the need in making rather complex drive constructions arises that would enable, respectively, to ensure sufficiently great stamping forces and rolling speed. Further, in a case of such slipping the external surface of blanks is negatively affected and their accuracy is compromised, since it becomes necessary to consider (design or select experimentally) the compliance of the blank weight and size with the die size.

Further, various devices for stamping with rolling are known, wherein a blank is positioned between two rolls, each having a profiled working surface corresponding to the form of a finished part to be produced, and the blank is rolled to a finished part after the rolls are pressed with a certain force thereto, for example (SU, No. 1027904), (RU, U1, No. 26459), (SU, No. 617145).

These technical solutions use longitudinal rolling, wherein rolls are continuously moved (rotated) along the longitudinal axis of the blank.

Stamping with longitudinal rolling is limited by low accuracy of complex geometric parts made, e.g., it is practically impossible to produce turbine blades by using this type of rolling.

Such low accuracy is caused by the fact that the physical and mechanical characteristics of blanks, as taken in different areas of rolled sheets, significantly differ from each other and have different lengths at similar deformations. This is the reason, e.g., for the failed attempt of batch production by longitudinal rolling of such simple parts as blanks for medical forceps which halves were significantly different in length.

Apart from non-uniform physical and mechanical characteristics, this process is, evidently, affected by non-uniformity of friction forces arising when blanks are moved relative to rolls.

A method for stamping with rolling and a device for implementing the same are known (RU, C2, No. 2338615), wherein the technical solution is characterized by the fact that a blank, which is positioned in a die arranged on a die bed, is rolled by a roll connected to a drive imparting jigging motion to the roll when the latter is pressed to the blank with a certain force, the roll being provided with a toothed sector and the die bed being provided with a rack bar, and during rolling the blank by the roll the teeth of the toothed sector are in constant engagement with the teeth of the rack bar for the purpose of changing the rolling process condition.

This technical solution enables, owing to selection of the roll diameter equal or different from the reference diameter of the toothed sector, ensuring either rolling without slipping and friction, at which a blank is deformed only due to a force of pressing the roll to a blank, or rolling with friction, during which additional deformation of the blank material takes place in the roll rotation direction, or rolling with friction, during which additional deformation of the blank material takes place in the direction that is opposite to the roll rotation direction.

This technical solution exhibits a drive made of four hydraulic cylinders, a frame, a rocker, two hydraulic cylinders being installed in the upper part of the frame and the other two hydraulic cylinders being installed in its lower part, and a die bed being installed on a frame partition therebetween, the ends of the two upper hydraulic cylinders being pivotally connected to the frame, and their rods being pivotally connected to the rod on its upper side, the ends of the two lower hydraulic cylinders being pivotally connected to the frame, and their rods being pivotally connected to the rocker on the lower side, and the roll installed on the lower side of the rocker between the hydraulic cylinders over the die.

As compared to the known analogous solutions, wherein jigging motion is imparted to the roll, this technical solution enables decrease of a maximum stamping force and a rolling speed.

However, this technical solution also has a significant limitation as to accuracy of producing a finished part, especially when producing articles of complex geometry with low tolerances for deviation from specified dimensions, such as, for example, turbine blades.

This is due to the fact that, when a blank is rolled transversely toward one of its faces, the rotation center of the roll periphery is shifted toward the same face, which means that deforming forces applied to a blank are shifted to the same face also. The horizontal component of the acting force tends, due to friction forces, to shear the upper layer of the blank. The same takes place when the other face of the blank is rolled, but at this time the blank additionally tends to take a symmetrical position between the working surfaces of the roll and the die. Therefore, when a blank is rolled toward its other side, the blank edge, which is non-deformed, is raised relative to the die base. As a result, the geometry (shape) of a finished part and its dimensions do not coincide with the dimensions and the form of the die. And such non-coincidence can be observed both on the top face of a finished part, and on its bottom face.

SUMMARY OF THE INVENTION

The present invention is based on the task of creating a method for stamping with rolling and an associated device that allow raising the quality of forged pieces produced due to improving their shaping regularity and reproduction accuracy of specified dimensions, and, thus, improving quality of producing complex-geometry articles.

In order to solve this task, the claimed method for stamping and rolling consists in that a blank is positioned between two rolls, each of them having a profiled working surface corresponding to the form of a finished part, and, after pressing the rolls with their drive to the blank with a certain force, the blank is rolled by the said rolls for the purpose of producing the finished part, the said rolling is carried out alternatively in transverse directions relative to the longitudinal axis of the blank, the said drive imparts jigging motion to the rolls in opposite directions.

Additional embodiments of the claimed method are possible, wherein it is preferred that:

- rolling is started in the area of the blank longitudinal axis;
- the drive is provided with a rack bar, and the rolls are provided with toothed sectors, one of the latter being in engagement with the rack bar and with the teeth of another toothed sector during rolling, and the rack bar is made with a support for fixing the blank in it;
- during rolling the blank is shifted from its longitudinal axis to the value of $\Delta l$ equal to $(2\pi R/360)\ \alpha$, where R is the radius of the roll working surfaces, $\alpha$ is the turning angle of the rolls relative to the vertical longitudinal axis.

The stated task is solved owing to the fact that the device for stamping with rolling comprises: an upper roll and a lower roll, a frame, two hydraulic power cylinders arranged in their upper part in the frame walls and made with pivot levers that form an articulated four-link mechanism kinematically, an upper thrust bearing, an upper axle rotatably installed in the upper thrust bearing, the upper roll being attached to it, the said articulated four-link mechanism is made with the possibility of lifting/lowering the upper roll together with the upper thrust bearing and the upper axle and of transferring a rolling force to the upper roll, two pivot hydraulic cylinders arranged in the lower part of the frame, a rocker, a lower thrust bearing, a lower axle rotatable installed in the lower thrust bearing, the lower roll being attached to it, the central part of the rocker being connected to the lower axle, and the rods of the pivot hydraulic cylinders being pivotally connected to the ends of the rocker with the possibility of transferring oppositely directed torques and the rolling force, a wedge mechanism arranged in the lower part of the frame and is coupled to the lower end face of the lower thrust bearing with the possibility of lifting/lowering the lower roll together with the lower thrust bearing and the lower axle and transferring a rolling force to the lower roll, a rack bar arranged in thrust blocks between the frame walls in the field of the roll working surfaces with the possibility of being moved horizontally during rolling, the lower roll and the upper roll are provided with toothed sectors arranged on the ends of the upper axle and the lower axle, respectively, during rolling the teeth of the lower roll toothed sector being in engagement with the teeth of the rack bar and those of the upper roll toothed sector, and the rack bar is made with a support for fixing the blank in it.

Additional developments of the device are possible, wherein it is advisable that:

- the thrust blocks are made adjustable, with the possibility of moving the rack bar vertically;
- the rack bar is made as a frame with a support which opening is designed for arranging a blank;
- the upper thrust bearing and the lower thrust bearing are made according to the same design with a cylindrical recess intended for arranging the respective thrust bearing therein, a pad for securing the upper and the lower rolls, respectively, being made on the face opposite to the bottom of the cylindrical recess of the upper axle and the lower axle, and on the respective ends of the upper axle and the lower axle a cross groove for the purpose of arranging and securing a toothed sector therein;
- the rod of each hydraulic power cylinder is pivotally connected to two pivot arms, the end of one of them being pivotally connected to the frame ceiling and the end of the other one being pivotally connected to the end face of the upper thrust bearing;
- the upper and the lower rolls are removably secured on the upper and the lower axles, respectively.

Below the above-said advantages as well as the specific features of this invention are explained on its best embodiment with reference on the accompanying drawings.

DESCRIPTION OF THE BEST EMBODIMENT OF THE INVENTION

Figure 1:
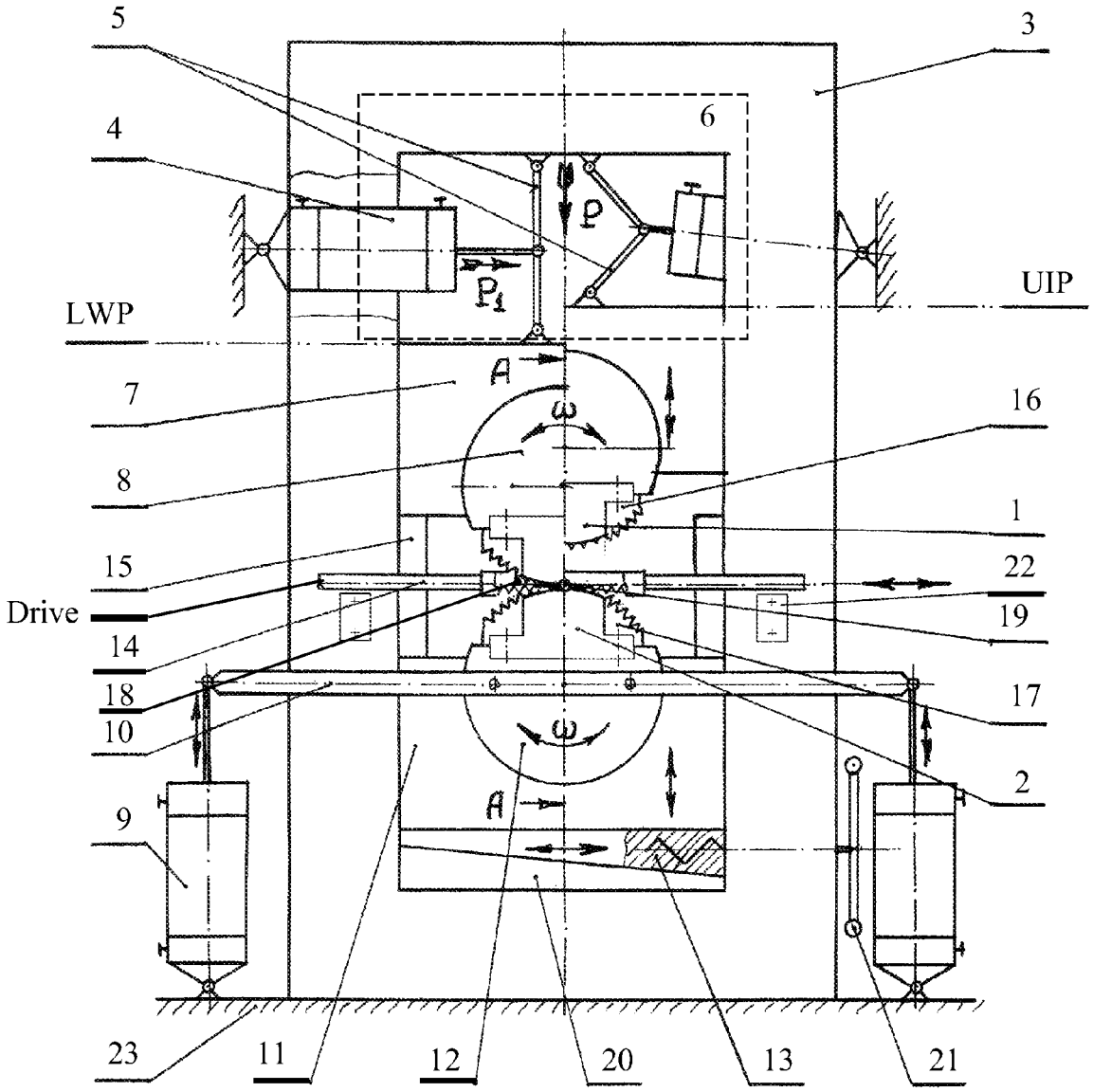
FIG. 1 shows a kinematic diagram of the claimed device.

Since the claimed method may be implemented directly when the device is operated, one of possible embodiments of the device will be described first.

The device for stamping and rolling (FIG. 1, 2) comprises an upper roll 1, a lower roll 2 and a frame 3. Two hydraulic power cylinders 4 are arranged in the upper part in the walls of the frame 3 and are provided with pivot arms 5 cinematically forming an articulated four-link mechanism 6. The device has an upper thrust bearing 7, an upper axle 8 rotatably arranged in the upper thrust bearing 7 and having the upper roll 1 secured thereto. The articulated four-link mechanism 6 is made with the possibility of lifting/lowering the upper roll 1 together with the upper thrust bearing 7 and the upper axle 8 and transferring a rolling force P to the upper roll 1.

Two pivot hydraulic cylinders 9 are arranged in the lower part of the frame 3. The device also comprises a rocker 10, a lower thrust bearing 11, a lower axle 12 rotatably arranged in the lower thrust bearing 11, the lower roll 2 being secured on the lower axle 12. The central portion of the rocker 10 is connected to the lower axle 12, and the rods of the pivot hydraulic cylinders are pivotally connected to the ends of the rocker 10 with the possibility of transferring oppositely directed torques and rolling force to the lower roll. A wedge mechanism 13 is arranged in the lower part of the frame 3 and is coupled to the lower end face of the lower thrust bearing 11 with the possibility of lifting/lowering the lower roll together with the lower thrust bearing 11 and the lower axle 12 and transferring a rolling force to the lower roll 2. A rack bar 14 is arranged in thrust blocks 15 between the walls of the frame 3 in the area of the working surfaces of the rolls 1 and 2 with the possibility of being moved horizontally during rolling. The upper roll 1 and the lower roll 2 are provided with toothed sectors 16 and 17 located on the end faces of the upper axle 8 and the lower axle 12, respectively. During rolling, the teeth of the toothed sector 17 of the lower roll 2 are in engagement with the teeth of the rack bar 14 and the teeth of the toothed sector 16 of the upper roll 1. The rack bar 14 is made with a support 18 for fixing a blank 19 therein.

Also, FIG. 1 schematically shows: a thrust block 20 of the wedge mechanism 13, a control wheel 21 for moving the wedge of the wedge mechanism 13, means 22 for adjusting the position of the thrust blocks 15 vertically, a base 23, $P_1$—force of the hydraulic power cylinder 4, P—force of rolling a blank 19, LWP—lower working position, UIP—upper idle position, (explanation: LWP, at which the rods of the hydraulic power cylinders 4 are extended, is shown on the left of the device longitudinal axis, and UIP, at which the rods of the hydraulic power cylinders 4 are retracted, is shown on the right of the longitudinal axis). The ends of the hydraulic power cylinders 4 that are opposite to their rods may be pivotally arranged on the side columns or on the side walls of the frame 3, and the ends of the pivot hydraulic cylinders 9 may be pivotally arranged on the base 23 or on the floor of the frame 3.

Figure 2:
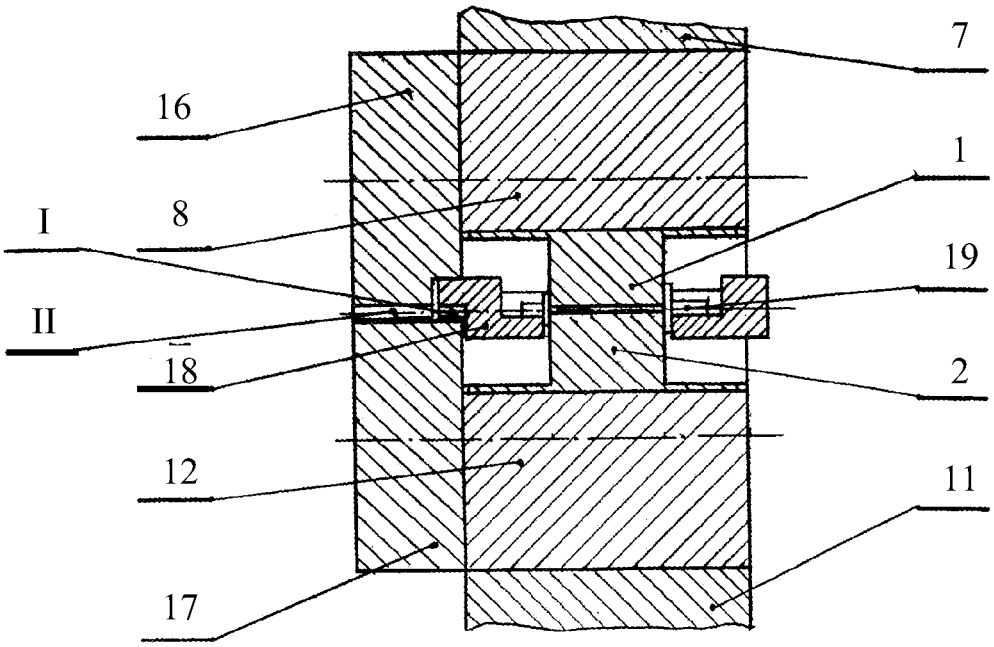
FIG. 2 shows the A-A section of FIG. 1.

FIG. 2 shows: I—area of engagement between the toothed sector 17 of the lower roll 2 and the rack bar 14, II—area of engagement of the toothed sector 17 of the lower roll 2 and the toothed sector 16 of the upper roll 1.

The thrust blocks 15 may be made adjustable with the means 22 with the possibility of moving the rack bar 14 (FIG. 1) vertically.

Figure 3:
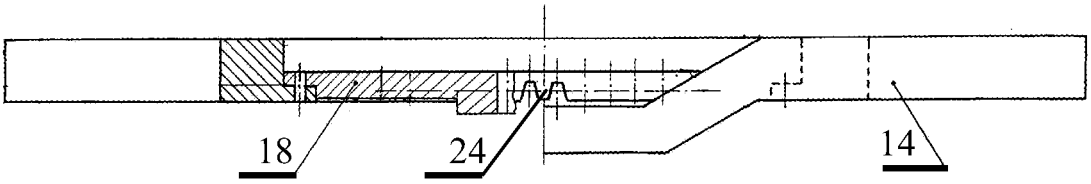
FIG. 3 shows the rack bar, front view.
Figure 4:
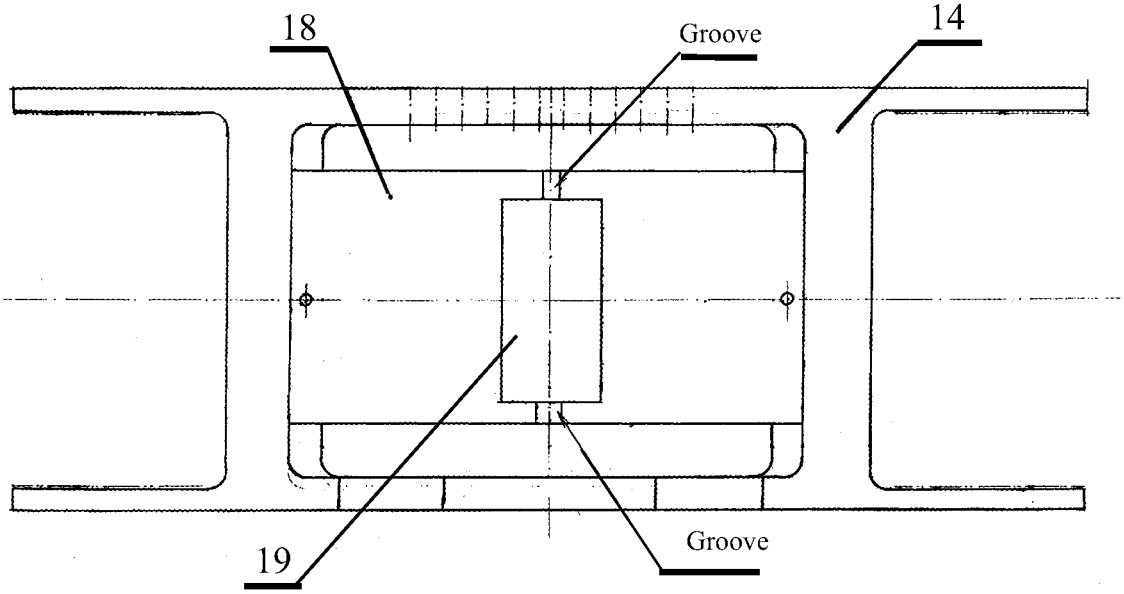
FIG. 4—the same as FIG. 3, top view.

Further, the rack bar 14 is made in the form of a frame with the support 18 having an opening that is intended for arranging a blank 19 (FIG. 3, 4). The front view (FIG. 3) shows the teeth 24 of the rack bar 14, which face downward on the distant part of the frame, and the support 18. The top view (FIG. 4) shows the support 18 with the opening (where the working surfaces of the upper and the lower rolls 1, 2 are accommodated, and a blank 19 with cylindrical shanks is introduced into the frame grooves and into the opening of the support 18. The slots of the teeth 24 of the rack bar 14 are shown by dash-and-dot lines on the top view.

Figure 5:
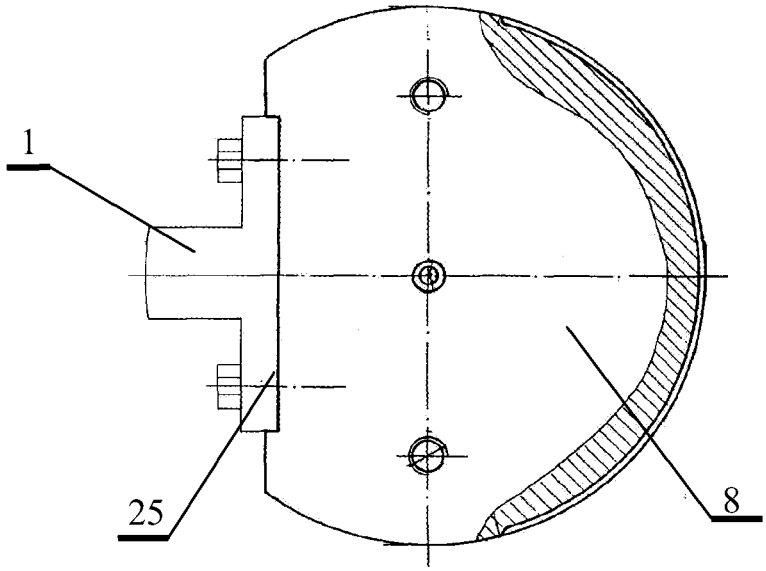
FIG. 5 shows a possible embodiment of the axle.
Figure 6:
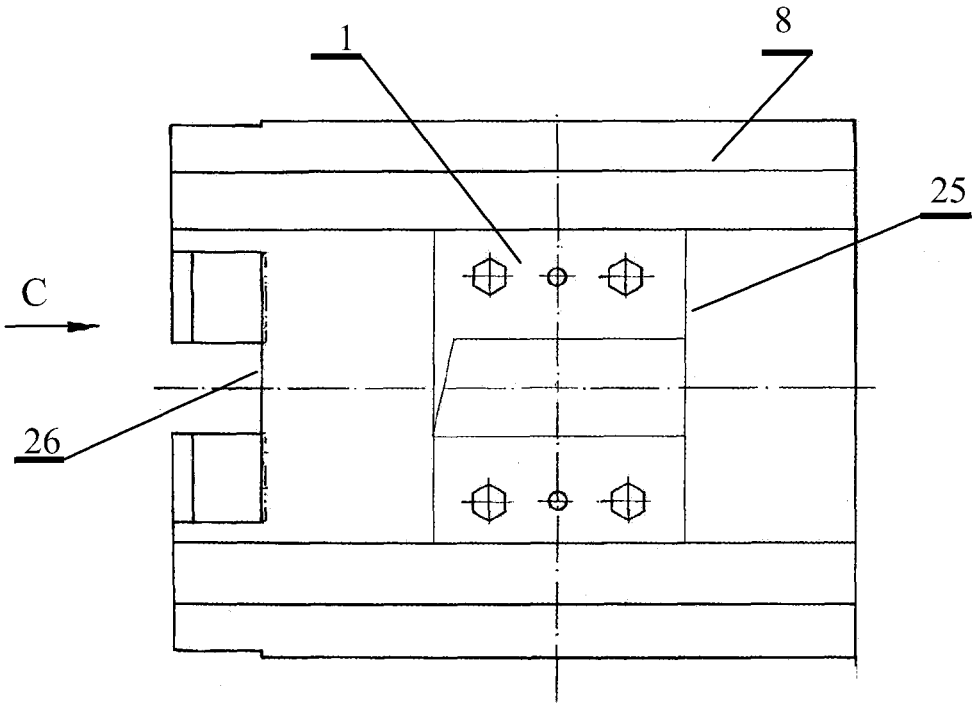
FIG. 6—the same as FIG. 5, viewed from the side of securing the roll.
Figure 7:
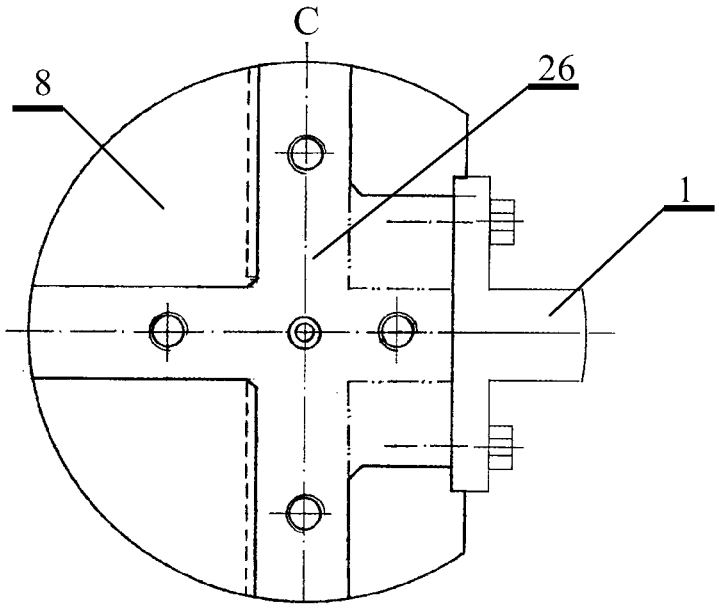
FIG. 7 shows View C of FIG. 6.

The upper and the lower thrust bearings 7, 11 (FIG. 1) may have the same design with a cylindrical recess, and also the upper and the lower axles 8, 12 (FIG. 1, 5-7) may have the same design of a cylindrical form for arranging the thrust bearing 7 or 11 in the cylindrical recess (though the said members may differ in their dimensions). A pad 25 for securing the upper and the lower rolls 1, 2 is made on the upper axle 8 (and the lower axle 12), on the side that is opposite to the cylindrical recess bottom, respectively, and on the end of the upper axle 8 and the lower axle 12 is made a cross groove 26 (FIG. 7) for arranging and securing the toothed sector 16 or 17, respectively, therein. FIG. 5-7 show that the rolls may be removable, e.g., may be attached to the axles by four bolts. A cross projection is made on the end of the toothed sector 16 or 17, which is introduced into the cross groove 26 and is fixed there by four studs.

The rod of each of the hydraulic power cylinders 4 (FIG. 1) of the articulated four-link mechanism 6 is pivotally connected to the two pivot arms 5, the end of one of which is pivotally connected to the ceiling of the frame 3, and the end of the other one is pivotally connected to the end face of the upper thrust bearing 7.

The upper and the lower rolls 1, 2 may be removably secured to the upper and the lower axles 8 and 12 (FIG. 5-7).

It will be understood by those skilled in the art that other embodiments of the device for stamping and rolling are possible that would not change the essence of the claimed method according to the first independent claim.

The device for stamping and rolling (FIG. 1, 2) can be operated as follows.

The frame 3 is rigidly connected to the base 23. The hydraulic power cylinders 4 are arranged in the upper part of the frame 3 oppositely to each other and are connected by their rods to the articulated four-link mechanism 6 used for lifting the upper thrust bearing 7 to the level of the upper idle position (UIP) where blanks 19 may be changed (see, FIG. 1—to the right of the longitudinal axis), or for lowering the upper thrust bearing 7 to the level of the lower working position (LWP) where a blank 19 is stamped and rolled (see, FIG. 1—to the left of the longitudinal axis).

The wedge mechanism 13 with a screw micro-feed means is arranged in the lower part of the frame 3 and is provided with the control wheel 21. Owing to this wedge mechanism 13 a required operating clearance between the upper roll 1 and the lower roll 2 is ensured.

The thrust blocks (limiting) 15 and the rack bar 14 with the support 18 for fixing a blank 19 are arranged between the upper and the lower thrust bearings 7 and 11.

At the LWP the rack bar 14 is in engagement with the toothed sector 17 for the lower roll 2, and at the same time the toothed sector 17 is in engagement with the toothed sector 16 for the upper roll 1, which ensures an equal movement speed of the rolls 1, 2 and the rack bar 14 in the area where they cross the vertical plane going through the upper axle 8 and the lower axle 12.

The rack bar 14 is arranged in the thrust blocks 15 and may freely move horizontally, and, due to the means 22 of adjusting their positions for adjusting a clearance between the rolls 1 and 2 by the wedge mechanism 13, also vertically. The purpose of the thrust blocks 15 is to ensure a secured clearance between the rolls 1 and 2 according to minimum allowable dimensions of a blank 19 in width. Further, deformation volume of a blank 19 may be changed due to lifting of the lower thrust bearing 11 by using the wedge mechanism 13 and its control wheel 21.

The use of the means 22 of adjusting and supports 18 of different designs and intended for different blanks 19 enables expansion of the range of parts to be produced by using the removable rolls 1 and 2 having the profiled working surface corresponding to forms of various parts.

The hydraulic power cylinders 4 and the pivot hydraulic cylinders 9 are actuated from a pump station (not shown in the drawings). The hydraulic power cylinders 4 work in cooperation, i.e., they close or open relative to each other simultaneously, and the pivot hydraulic cylinders 9 act on the rocker 10 in different directions. The lower axle 12 together with the roll 2 and the toothed sector 17 are turned by the rocker 10 under the action of the two pivot hydraulic cylinders 9.

The upper axle 8 together with the roll 1 and the toothed sector 16 are turned by means of engagement between the toothed sector 16 and the toothed sector 17 that, at the same time, moves the rack bar 14 with a blank 19.

Thus, a blank 19 is sized by stamping and rolling due to its fixation in the support 18 of the rack bar 14 and setting a required clearance between the upper roll 1 and the lower roll 2 by lowering the upper thrust bearing 7 to the LWP with the use of the hydraulic power cylinders 4 and the articulated four-link mechanism 6 when the lifting is adjusted by the wedge mechanism 13 of the lower thrust bearing 11.

Figure 8:
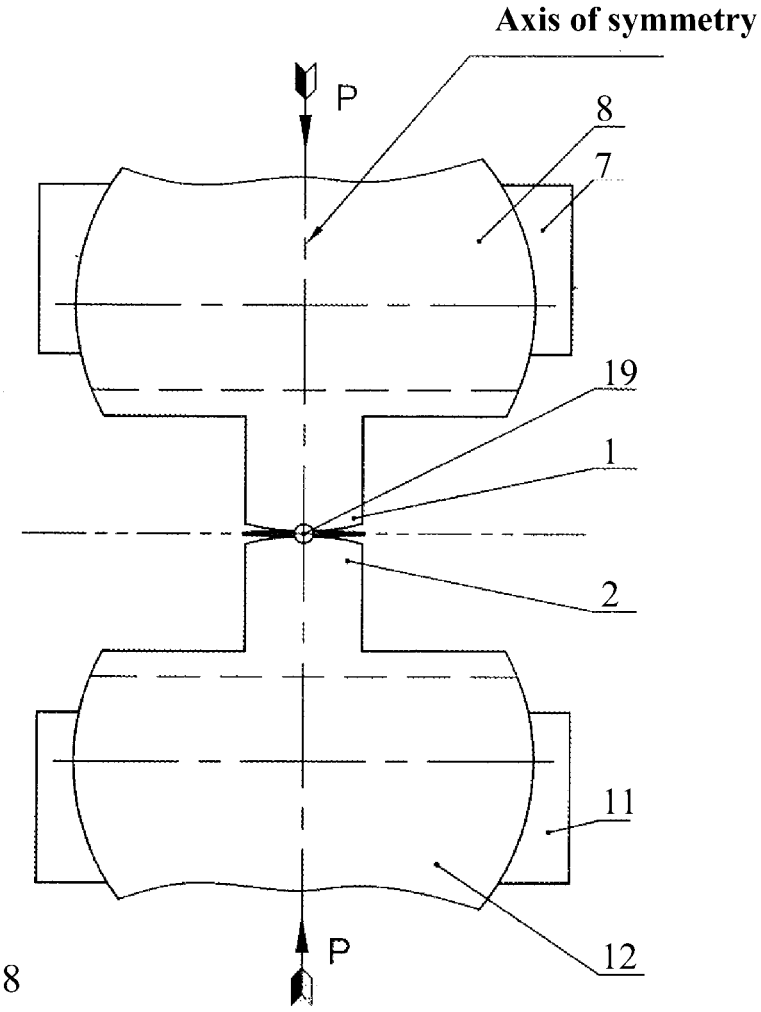
FIG. 8 schematically shows the initial position of the rolls.

It is advisable to start rolling in the area of the longitudinal axis of a blank 19 (FIG. 8).

Further, the pivot hydraulic cylinders 9 are activated, which turn the upper and the lower axles 8 and 12 with the rolls 1 and 2 by means of the rocker 10 to the angle $\alpha_1$ (FIG. 9), simultaneously moving the blank 19 to the right from the axis of symmetry by the amount $\Delta l_1$ equal to $(2\pi R/360)\ \alpha_1$, where R is the radius of the working surface of the rolls 1 and 2, which in this case is selected as equal to the radius of the cylindrical surface of the axles 8 and 12. This is used for sizing the left (in a cross-section) side of the blank 19.

Similar to this, after turning to the angle $\alpha_2$ (FIG. 10), the right side of the blank 19 is sized with simultaneously moving the blank 19 to the left from the axis of symmetry by the amount $\Delta l_2$.

Figure 9:
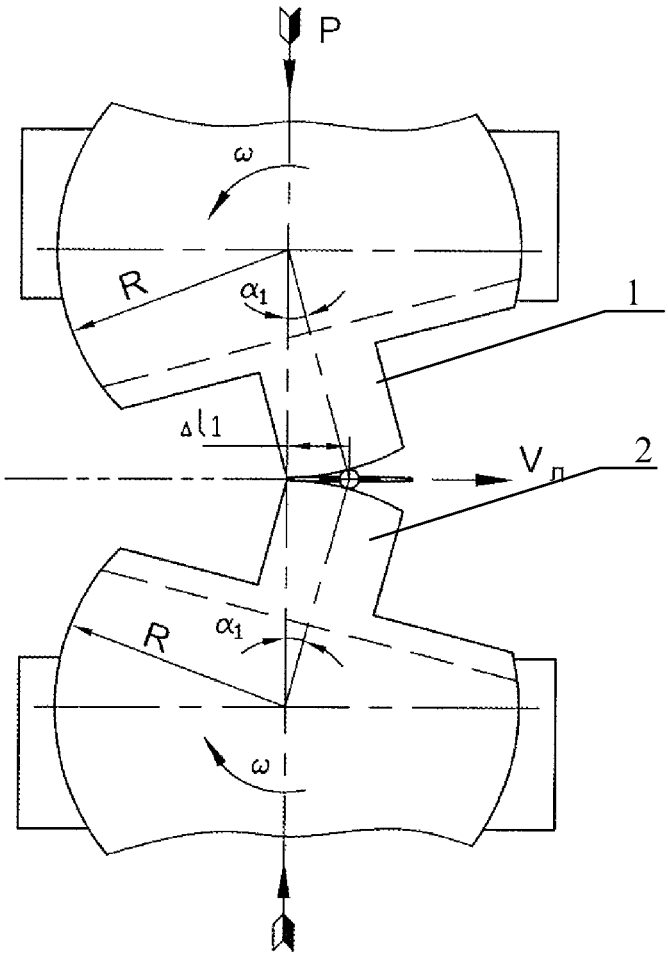
FIG. 9—the same as FIG. 8, rolling to the left.
Figure 10:
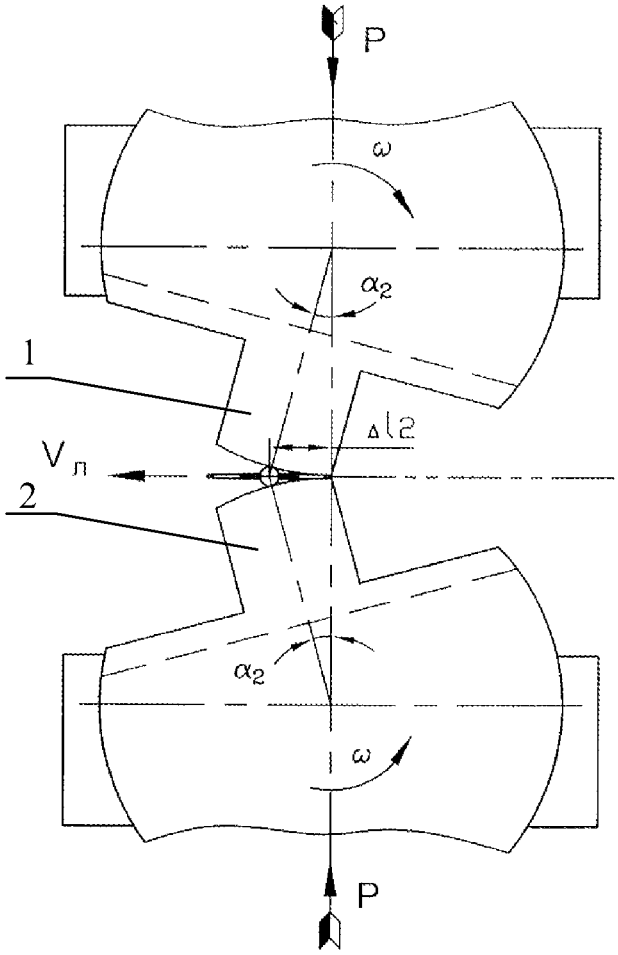
FIG. 10—the same as FIG. 8, rolling to the right.

It can be seen on FIGS. 8, 9, 10 that the main advantage from one-sided stamping with rolling, when only one roll is moved in a jigging way, is that the blank deformation area constantly lies in the plane P-P. The horizontal component of the force, which shears the upper layer of the blank 19, is missing. As a result, the form of a finished blank and its dimensions fully comply with the impressions of the working surface of the rolls 1 and 2 both on the top face of a finished part, and on the bottom face thereof.

Figure 11:
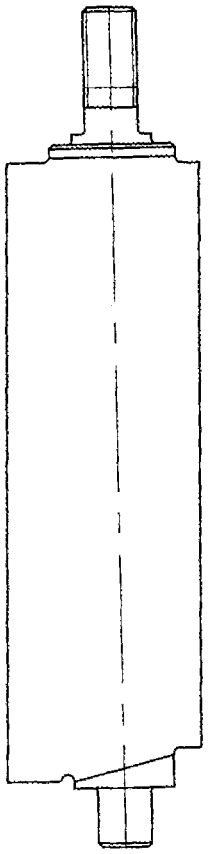
FIG. 11—a finished article—turbine blade, top view.
Figure 12:
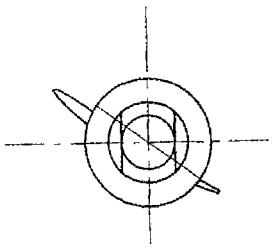
FIG. 12—the same as FIG. 11, front view.

FIGS. 11 and 12 show a turbine blade made according to the claimed method, which cannot be made with high accuracy by longitudinal rolling or by commonly used methods for transverse rolling with jigging motion of only one roll and with the use of a die.

After stamping with rolling is finished, the rocker 10 (FIG. 1) takes a horizontal position, and the upper thrust bearing 7 is lifted up to the UIP by the hydraulic power cylinders 4 by means of the articulated four-link mechanism 6.

The blank is replaced by the next one.

Thus, the claimed method is characterized by the fact that a blank 19 is arranged between the two rolls 1 and 2, each of them having a profiled working surface corresponding to the form of the finished part, and, after pressing the rolls 1 and 2 with a certain force to the blank with the use of a drive, it is rolled by them for the purpose of producing the finished part, the rolling being carried out in transverse directions relative to the blank longitudinal axis with the use of the drive imparting jigging motion in opposite directions to the rolls 1 and 2 (FIG. 1, 8-10).

Furthermore, is advisable to start rolling in the area of the longitudinal axis of a blank 19 (FIG. 8).

Additionally, the drive is provided with the rack bar 14, and the rolls 1, 2 are provided with the toothed sectors 16, 17, one of them, being in engagement with the rack bar 14 and with the teeth of the other toothed sector during rolling, and the rack bar 14 is made with the support 18 for fixing a blank therein (FIG. 1-4).

During rolling, a blank 19 is moved from its longitudinal axis by the amount $\Delta l$ equal to $(2\pi R/360)\ \alpha$, where R is the radius of the working surface of the rolls 1 and 2, and $\alpha$ is the turning angle of the rolls 1 and 2 relative to the longitudinal vertical axis of the blank 19.

INDUSTRIAL APPLICABILITY

The claimed method can be most beneficially used for producing complex-shaped articles.

What is claimed is:

1. A method for stamping and rolling comprising:

a blank arranged between two rolls having profiled working surfaces that correspond to the geometry of a finished part, said rolls provided with toothed sectors, the toothed sectors in engagement with each other, wherein after pressing the rolls with a certain force to the blank with the use of a drive, the blank is rolled by the rolls for the purpose of producing the finished part, the rolling being carried out in transverse directions relative to a blank longitudinal axis with the use of two pivot hydraulic cylinders connected to one of the rolls via a rocker and acting on the rocker in different directions thereby, said hydraulic cylinders imparting a jigging motion of the rolls which rotate in opposite directions due to said toothed engagement, and simultaneous movement of the blank by a rack bar being in engagement with at least one of the toothed sectors of one of the rolls, wherein the blank is fixed in the rack bar.

2. The method according to claim 1, wherein rolling is started in an area of the blank longitudinal axis.

3. The method according to claim 2, wherein during rolling the blank is moved from the blank longitudinal axis by the amount $\Delta l$ equal to $(2\pi R/360)\alpha$, where R is the radius of the working surface of the rolls, and $\alpha$ is the turning angle of the rolls relative to a vertical axis which is perpendicular to the blank.

4. A device for stamping and rolling, comprising:

an upper roll and a lower roll;

a frame;

two hydraulic power cylinders arranged in an upper part in walls of the frame and provided with pivot arms kinematically forming an articulated four-link mechanism;

an upper thrust bearing;

an upper axle rotatably arranged in the upper thrust bearing and having the upper roll secured thereto, wherein said articulated four-link mechanism is arranged to lift/lower the upper roll together with the upper thrust bearing and the upper axle and transfer a rolling force to the upper roll;

two pivot hydraulic cylinders arranged in a lower part of the frame;

a rocker;

a lower thrust bearing;

a lower axle rotatably arranged in the lower thrust bearing and having the lower roll being secured therein, wherein a central portion of the rocker being connected to the lower axle, and rods of the pivot hydraulic cylinders being pivotally connected to ends of the rocker with the possibility of transferring oppositely directed torques and rolling force to the lower roll;

a wedge mechanism arranged in the lower part of the frame and coupled to a lower end face of the lower thrust bearing capable of lifting/lowering the lower roll together with the lower thrust bearing and the lower axle and transferring the rolling force to the lower roll;

a rack bar arranged in thrust blocks between the walls of the frame in an area of working surfaces of the rolls capable of being moved horizontally during rolling;

the upper roll and the lower roll are provided with toothed sectors located on end faces of the upper axle and the lower axle, respectively, wherein during rolling teeth of the toothed sector of the lower roll being in engagement with teeth of the rack bar and teeth of the toothed sector of the upper roll; and the rack bar having a support for fixing a blank therein, wherein the rods of the hydraulic power cylinders are each pivotally connected to the two pivot arms, and the end of one of latter being pivotally connected to the frame ceiling and the end of the other one being pivotally connected to the end face of the upper thrust bearing.

5. The device according to claim 4, wherein the thrust blocks are adjustable and capable of moving the rack bar vertically.

6. The device according to claim 4, wherein the rack bar is made in the form of the frame with the support having an opening intended for arranging the blank.

7. The device according to claim 4, wherein the upper and the lower thrust bearings are geometrically shaped of the same design and provided with a cylindrical recess, and also the upper and the lower axles are geometrically shaped of the same design as a cylindrical form for arranging a thrust bearing in a cylindrical recess;

a pad for securing the upper and the lower rolls provided on the upper axle and the lower axle, respectively, on a side that is opposite to the cylindrical recess bottom; and on an end of the upper axle and the lower axle is a cross groove for arranging and securing the toothed sector therein.

8. The device according to claim 4, wherein the upper roll and the lower roll are removably secured, respectively, on the upper axle and the lower axle.

9. The method according to claim 1, wherein during rolling the blank is moved from the blank longitudinal axis by the amount $\Delta l$ equal to $(2\pi R/360)\alpha$, where R is the radius of the working surface of the rolls, and $\alpha$ is the turning angle of the rolls relative to a vertical axis which is perpendicular to the blank.

* * * * *